US009685070B2

(12) United States Patent
Yamada

(10) Patent No.: US 9,685,070 B2
(45) Date of Patent: Jun. 20, 2017

(54) DEVICE, SYSTEM AND METHOD FOR INFORMING ALARM

(71) Applicant: Furuno Electric Co., Ltd., Nishinomiya (JP)

(72) Inventor: Katsuo Yamada, Nishinomiya (JP)

(73) Assignee: Furuno Electric Co., Ltd., Nishinomiya (JP)

( * ) Notice: Subject to any disclaimer, the term of this patent is extended or adjusted under 35 U.S.C. 154(b) by 13 days.

(21) Appl. No.: 14/681,936

(22) Filed: Apr. 8, 2015

(65) Prior Publication Data

US 2015/0294555 A1 Oct. 15, 2015

(30) Foreign Application Priority Data

Apr. 9, 2014 (JP) ..... 2014-080335

(51) Int. Cl.

| | |
|---|---|
| ***G08B 29/04*** | (2006.01) |
| ***G08B 7/06*** | (2006.01) |
| *B63B 49/00* | (2006.01) |
| *G08B 3/10* | (2006.01) |

(52) U.S. Cl.

CPC ..... *G08B 29/04* (2013.01); *G08B 7/06* (2013.01); *B63B 49/00* (2013.01); *G08B 3/10* (2013.01)

(58) Field of Classification Search

CPC ..... G08B 7/06; B63B 49/00

See application file for complete search history.

(56) References Cited

U.S. PATENT DOCUMENTS

| | | | | |
|---|---|---|---|---|
| 6,028,513 | A * | 2/2000 | Addy | G08B 25/016 340/12.52 |
| 2002/0101344 | A1* | 8/2002 | Tanguay | G08B 7/06 340/508 |
| 2006/0087421 | A1* | 4/2006 | Stewart | G08B 5/36 340/506 |
| 2008/0266064 | A1* | 10/2008 | Curran | G08B 7/06 340/293 |
| 2010/0295677 | A1* | 11/2010 | Egawa | G08B 3/10 340/540 |

FOREIGN PATENT DOCUMENTS

| | | |
|---|---|---|
| JP | 2003322693 A | 11/2003 |
| WO | 2013132999 A1 | 9/2013 |

OTHER PUBLICATIONS

"Resolution MSC.302(87)—Adoption of Performance Standards for Bridge Alert Management," International Maritime Organization, Annex 21, May 17, 2010, 18 pages.

* cited by examiner

*Primary Examiner* — Andrew Bee

(74) *Attorney, Agent, or Firm* — Alleman Hall Creasman & Tuttle LLP

(57) ABSTRACT

An alarm informing device is provided. The alarm informing device receives detection information from one or more sensors and informs an alarm to a user when either one of failure in the one or more sensors and error in the reception of the information from the one or more sensors occurs. The alarm informing device includes a time synchronizing module configured to synchronize an internal clock of the alarm informing device with an internal clock of another alarm informing device, an alarm sound output timing control module configured to control a timing of outputting an alarm sound when the alarm is issued, based on the internal clock of the alarm informing device, and a sound outputter configured to output the alarm sound at the timing controlled by the alarm sound output timing control module.

16 Claims, 11 Drawing Sheets

DEVICE, SYSTEM AND METHOD FOR INFORMING ALARM

CROSS-REFERENCE TO RELATED APPLICATION(S)

This application claims priority under 35 U.S.C. §119 to Japanese Patent Application No. 2014-080335, which was filed on Apr. 9, 2014, the entire disclosure of which is hereby incorporated by reference.

TECHNICAL FIELD

This disclosure generally relates to an alarm informing device, which aurally informs alarms to a user.

BACKGROUND OF THE INVENTION

Some of systems including various instruments (e.g., measuring instruments) are configured to monitor operation statuses of the respective instruments and draw attention of a user by informing alarms to the user when abnormality occurs, etc. Recently, alarm display devices which visually or aurally inform alarms to users from various monitoring systems and various instruments are provided.

WO2013/132999A1 discloses an alarm display device. The alarm display device of WO2013/132999A1 includes a display unit, an alarm information acquiring module, an information memory, a transmission source classification list memory, an importance list memory, a display target specifying module, an information selecting module, an alarm information displaying module, and a sound notifier which informs issuance of an alarm by sound. The alarm information displaying module only displays display alarm information in the form of a list. The display alarm information is selected, by the information selecting module, from display targets specified by the display target specifying module, based on lists stored in the memories. Thus, according to WO2013/132999A1, by only displaying the alarm information specified as the display target in the form of a list, the alarm information can be displayed in a visibly easily understandable manner.

JP2003-322693A discloses a monitoring control system having a time synchronization method. The monitoring control system of JP2003-322693A includes a monitoring device, control devices, a reference clock, and an internal clock. The internal clock has a clock function to calculate an internal time by combining a time signal with a supplemental time, and synchronizes, by the clock function, the internal time with a reference time of the reference clock by one millisecond unit. The time signal is synchronized with the reference time. The supplemental time is obtained by counting a clock signal having one millisecond cycle. Thus, according to JP2003-322693A, in the system including two or more control devices which store a change of a state of a monitoring target along with the time of the change, the time can be synchronized among the control devices highly accurately.

In WO2013/132999A1, the alarm information is mainly displayed on a display screen. Note that, although the alarm display device of WO2013/132999A1 includes the sound notifier, the sound notifier aurally informs the alarm to the user simply at the timing of the alarm issuance. However, for example, on a ship where various kinds of navigation instruments are equipped, when alarms are issued in a plurality of instruments and alarm sounds are outputted therefrom, it is difficult to distinguish the kinds of the alarm sounds and the output sources, and there is a possibility of causing uncomfortableness to the user due to noises caused by the plurality of alarm sounds outputted here and there.

Moreover, although JP2003-322693A discloses the configuration of the monitoring control system which synchronizes time among the plurality of instruments, it does not disclose anything about outputting an alarm sound or controlling a timing of the output.

SUMMARY OF THE INVENTION

The purpose of this disclosure relates to providing an alarm informing device, which can inform, even when alarms are issued in a plurality of instruments, contents and importance of each of the alarms to a user in an easily understandable manner.

According to a first aspect of this disclosure, an alarm informing device with the following configuration is provided. Specifically, the alarm informing device receives detection information from one or more sensors and informs an alarm to a user when either one of failure in the one or more sensors and error in the reception of the information from the one or more sensors occurs. The alarm informing device includes a time synchronizing module configured to synchronize an internal clock of the alarm informing device with an internal clock of another alarm informing device, an alarm sound output timing control module configured to control a timing of outputting an alarm sound when the alarm is issued, based on the internal clock of the alarm informing device, and a sound outputter configured to output the alarm sound at the timing controlled by the alarm sound output timing control module.

Thus, the timing of outputting the alarm sound for informing the alarm to the user can be accurately controlled in association with the other alarm informing device, with reference to the synchronized time. Therefore, for example, even when alarms are simultaneously issued in the plurality of alarm informing devices, the timings of outputting the alarm sounds can be adjusted between the alarm informing devices, and thus, the alarms can be informed to the user in an instinctively easily-understandable manner.

The alarm informing device preferably has the following configuration. Specifically, the alarm informing device also includes a memory configured to store information regarding the timing of outputting the alarm sound from the alarm informing device, the timing being in association with the other alarm informing device. The alarm sound output timing control module controls the timing of the alarm sound output based on the stored information.

Thus, even when the alarms are simultaneously issued in the plurality of alarm informing devices, it can be avoided that the alarm sounds are outputted here and there, overlapped with each other randomly. Moreover, the plurality of alarm informing devices can inform the alarms to the user in an orderly manner.

The alarm informing device preferably has the following configuration. Specifically, as the information regarding the timing of outputting the alarm sound from the alarm informing device, the memory stores information for specifying a time frame assigned with the alarm informing device among a plurality of time frames prepared as candidates for outputting the alarm sounds therewithin.

Thus, when the alarms are simultaneously issued in the plurality of alarm informing devices, the alarms can be informed to the user without overlapping the output periods of the alarm sounds.

The timing of outputting the alarm sound of the alarm informing device is preferably controlled to match with a timing of outputting an alarm sound of the other alarm informing device when the alarm informing device is categorized in the same group with the other alarm informing device.

Thus, even when the alarms are simultaneously issued in the plurality of alarm informing devices, the alarms can be informed to the user in an easily understandable manner by outputting the alarm sounds in an organized manner per device group.

The alarm informing device preferably has the following configuration. Specifically, the alarm informing device also includes an interface configured to transmit information regarding importance of the alarm issued in the alarm informing device and receive information regarding importance of the alarm issued in the other alarm informing device, and an alarm sound output control module configured to control the alarm sound of the alarm informing device not to be outputted when the importance of the alarm issued in the other alarm informing device is higher than that of the alarm issued in the alarm informing device.

Thus, even when the alarms are simultaneously issued in the plurality of alarm informing devices, the number of the alarm sounds outputted simultaneously can be reduced. Moreover, the user can make a rational response of acknowledging from the highest importance level by simply following the order of the alarm sound outputs.

The alarm informing device may have the following configuration. Specifically, the importance of the alarm is defined in a plurality of levels. When the alarm is issued in the alarm informing device and an alarm at the same importance level as the alarm issued in the alarm informing device is issued in the other alarm informing device, the alarm sound of the alarm informing device is outputted the alarm sound so that an output period of time thereof overlaps with that of the alarm sound of the other alarm informing device, through the control by the alarm sound output timing control module.

Thus, even when the alarms are simultaneously issued in the plurality of devices, the alarms can be informed to the user in an easily understandable manner that is organized based on the importance level.

With the alarm informing device, when an output period of time of the alarm sound of the alarm informing device overlaps with that of the alarm sound of the other alarm informing device, a timing of starting to output the alarm sound of the alarm informing device is preferably matched with that of the alarm sound of the other alarm informing device, through the control by the alarm sound output timing control module.

Thus, it can be avoided that uncomfortableness to the user is caused by noises of the alarm sounds outputted at the respective timings from the alarm informing devices.

With the alarm informing device, the time synchronizing module preferably synchronizes the internal clock of the alarm informing device with a GNSS time.

Since the time is also synchronized between the alarm informing device and the other alarm informing device, the internal clocks of the plurality of alarm informing devices can be synchronized with the extremely accurate GNSS time. Therefore, the plurality of alarm informing devices can output the alarm sounds in cooperation with each other in terms of timing at high accuracy.

With the alarm informing device, the time synchronizing module preferably synchronizes the internal clock of the alarm informing device with the internal clock of the other alarm informing device by using either one of a network time protocol and a simple network time protocol.

Thus, the internal clocks of the plurality of alarm informing devices can be synchronized at extremely high accuracy. Therefore, each of the devices can operate in cooperation with each other at accurate timings.

According to a second aspect of this disclosure, an alarm informing system with the following configuration is provided. Specifically, the alarm informing system includes one or more sensors and a plurality of alarm informing devices for receiving detection information from the one or more sensors and informing an alarm to a user when either one of failure in the one or more sensors and error in the reception of the information from the one or more sensors occurs. Each of the plurality of alarm informing devices includes at least one of a radar and an electronic nautical chart display system, both of the radar and the electronic nautical chart display system being configured to provide navigation information based on the detection information from the one or more sensors. The one or more sensors include at least one of a GPS navigation system, a heading sensor, an acoustic depth meter, a radar sensor, a Doppler sonar, a wireless communication device, and an AIS. Each of the plurality of alarm informing devices includes a time synchronizing module configured to synchronize an internal clock of the alarm informing device with an internal clock of another alarm informing device, an alarm sound output timing control module configured to control a timing of outputting an alarm sound when the alarm is issued due to the either one of the failure and the error, based on the internal clock of the alarm informing device and a sound outputter configured to output the alarm sound at the timing controlled by the alarm sound output timing control module.

Thus, based on the detection information from the one or more sensors, the plurality of devices can provide a comprehensive navigation. Moreover, the timings of outputting the alarm sounds for informing the alarms indicating the failure of the one or more sensors or the like to the user can be accurately controlled between the plurality of alarm informing devices configuring the system with reference to the synchronized time. Therefore, for example, even when the alarms are issued simultaneously in the plurality of alarm informing devices, the timings of outputting the alarm sounds can be adjusted between the alarm informing devices, and thus, the alarm informing system that informs the alarms to the user in an instinctively easily-understandable manner can be provided.

According to a third aspect of this disclosure, a following method of informing an alarm is provided. Specifically, the method of informing the alarm is used in an alarm informing device for receiving detection information from the one or more sensors and informing an alarm to a user when either one of failure in the one or more sensors and error in the reception of the information from the one or more sensors occurs. The method of informing the alarm includes synchronizing an internal clock of the alarm informing device with an internal clock of another alarm informing device, controlling a timing of outputting an alarm sound when the alarm is issued, based on the internal clock of the alarm informing device, and outputting the alarm sound at the controlled timing.

Thus, the timing of outputting the alarm sound for informing the alarm to the user can be controlled in association with the other alarm informing device. Therefore, for example, even when the alarms are issued simultaneously in the plurality of devices, the alarm sounds can be outputted in an organized manner in terms of timing, so that the user can easily understand.

BRIEF DESCRIPTION OF THE DRAWING(S)

The present disclosure is illustrated by way of example and not by way of limitation in the figures of the accompanying drawings, in which the like reference numerals indicate like elements and in which.

DETAILED DESCRIPTION

Figure 1:
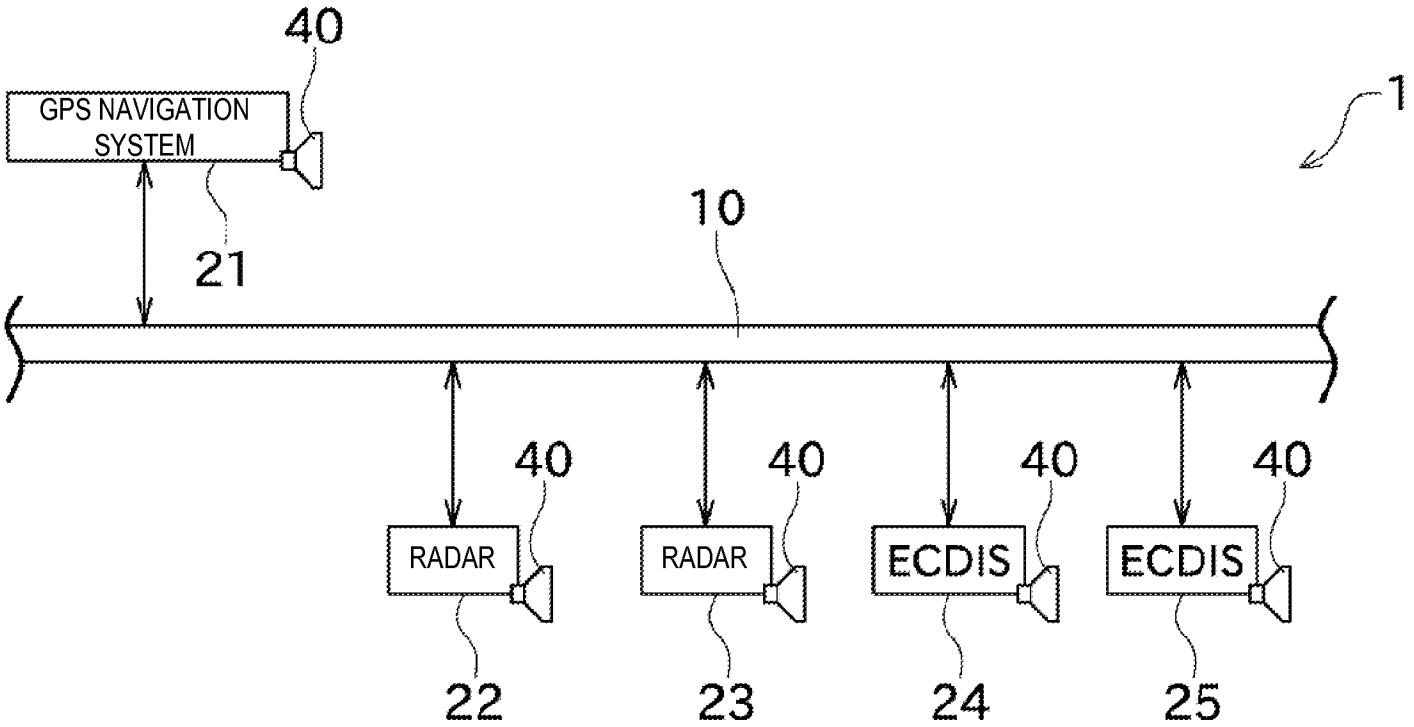
FIG. 1 is a schematic view of an alarm informing system according a first embodiment of this disclosure.
Figure 2:
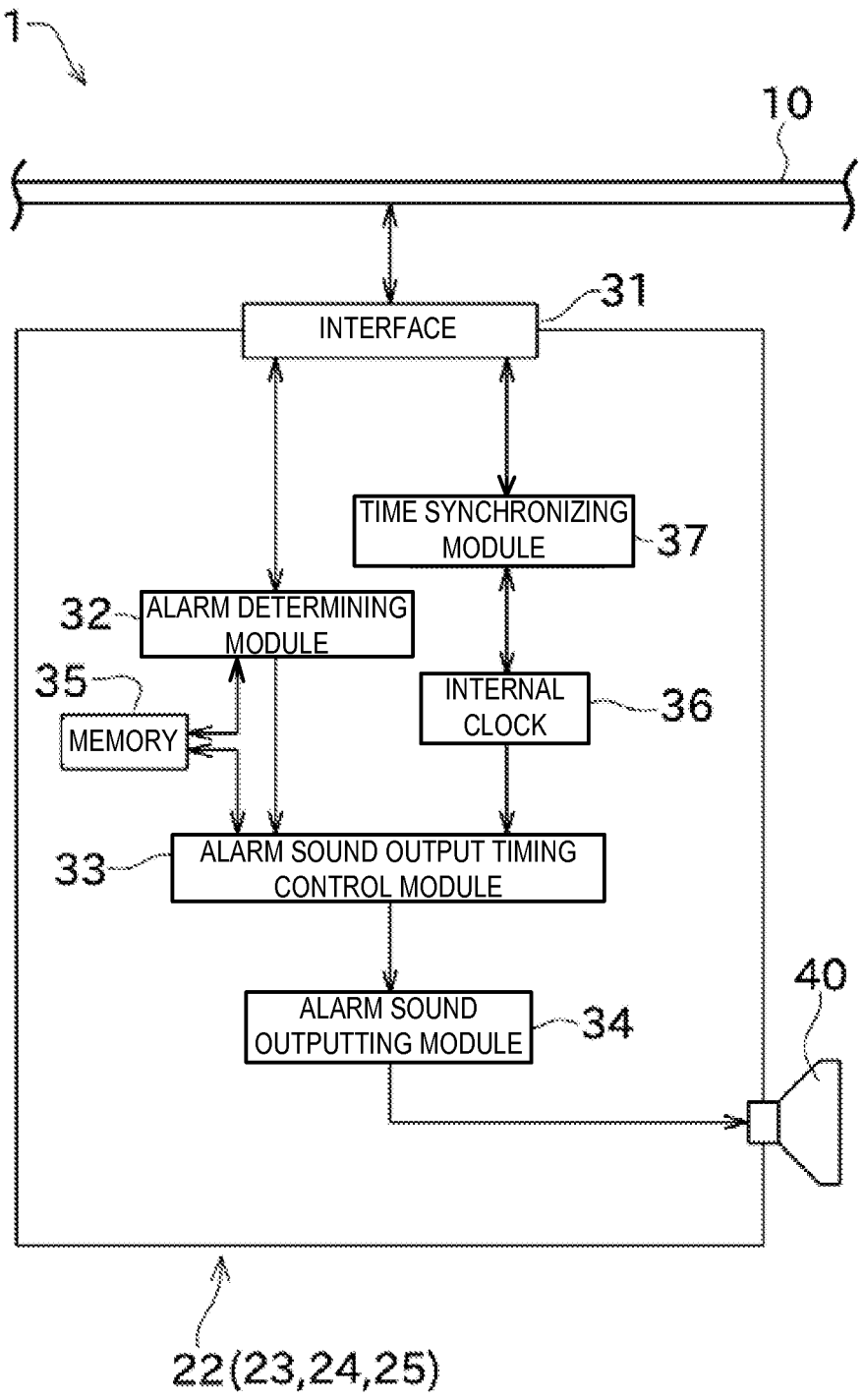
FIG. 2 is a block diagram illustrating a configuration for a control of alarm sounds outputted from instruments.

Next, embodiments of this disclosure are described with reference to the appended drawings. FIG. 1 is a schematic view of an alarm informing system 1 according a first embodiment of this disclosure. FIG. 2 is a block diagram illustrating a configuration for a control of an alarm sound outputted by a radar 22.

The alarm informing system 1 of the first embodiment provides navigation information to a user. The alarm informing system 1 includes a GPS navigation system 21, radars 22 and 23, and ECDISs 24 and 25. Note that, in the following description, components described above may simply be referred to as "instruments." Among the instruments 21 to 25, each of the radars 22 and 23 and the ECDISs 24 and 25 informs an alarm to a user, and may be referred to as the alarm informing device.

These instruments 21 to 25 are installed in a bridge of a ship (movable body). Moreover, the instruments 21 to 25 are connected with a network 10 structured on the ship. The instruments 21 to 25 can exchange various information thereamong, via the network 10.

The network 10 is a communication medium for the instruments of the alarm informing system 1, to exchange various kinds of information. The standard of the network 10 is not particularly limited, and a LAN or a serial interface compatible with NMEA-0183 may be used, for example.

The GPS navigation system 21 includes a GPS antenna (not illustrated) and displays, on a display unit, a position of the ship acquired by GPS positioning. Moreover, the GPS navigation system 21 transmits information of the acquired position of the ship to the other instruments 22 to 25.

Each of the radars 22 and 23 creates a radar image through transceiving radar signals via a radar antenna (not illustrated) and displays the radar image on a display unit. The information of the position of the ship acquired from the GPS navigation system 21 is used in creating the radar image.

The ECDISs are the abbreviation of "Electronic Chart Display and Information Systems." Each of the ECDISs 24 and 25 acquires the position of the ship from the GPS navigation system 21 and displays, on a display unit, a nautical chart of an area around the ship based on electronic nautical chart information stored beforehand.

Each of the radars 22 and 23 and the ECDISs 24 and 25 includes components configured to visually inform an alarm, such as an alarm lamp and the display unit, and also includes a buzzer (sound outputter) 40. Therefore, when an alarm is issued by one of the radars 22 and 23 and the ECDISs 24 and 25, by operating the corresponding buzzer 40 to output an alarm sound, the alarm can be aurally informed to the user. Hereinafter, a configuration for a control of each of the buzzers 40 of the radars 22 and 23 and the ECDISs 24 and 25 is described. Note that, since the configurations of the radars 22 and 23 and the ECDISs 24 and 25 are similar to each other in terms of the buzzers 40, hereinafter, the configuration of the radar 22 is representatively described.

As illustrated in FIG. 2, the radar 22 includes an interface 31, an alarm determining module 32, an alarm sound output timing control module 33, an alarm sound outputting module 34, a memory 35, an internal clock 36, and a time synchronizing module 37.

The interface 31 connects the radar 22 with the network 10. The radar 22 transceives various kinds of information with the other instruments 21 and 23 to 25 connected with the network 10 via their interfaces 31. The information exchanged via the network 10 includes information regarding time synchronization and information regarding alarms currently issued in the instruments 21 to 25.

The alarm determining module 32 observes states of the radar 22 itself and the other instruments 21, 23, 24 and 25, and determines whether to issue the alarm. The alarm determining module 32 issues the alarm as needed, for example, when some sort of abnormality occurs in the radar 22 itself or the information which is supposed to be received by the radar 22 from the other instruments 21, 23, 24 and 25 is not received.

Here, levels of importance (priority, urgency, vulnerability) of alarms defined in the alarm informing system 1 of this embodiment are described. Three levels of alarm levels are commonly defined in the instruments 21 to 25 configuring the alarm informing system 1 of this embodiment. The three levels of alarm levels include "Alarm," "Warning," and "Caution" in the order from the most important level. "Alarm" indicates that immediate attention and response are requested to a person on duty at the bridge. "Warning" indicates that although a current situation has no urgency, there is a possibility of eventually causing danger unless some sort of response is made. "Caution" indicates that although the current situation is not as severe as "Alarm" or "Warning", the information regarding the alarm requires attention and needs to be continuously observed.

Further, each of the radars 22 and 23 and the ECDISs 24 and 25 is designed to change the alarm sound to be outputted from the buzzer 40, according to the importance level of the alarm. Any method may be used to change the alarm sound, for example, a pattern of activating and stopping the buzzer 40 is changed or the height of the sound to be outputted is changed. In the following description, the alarm sound outputted in the case where the importance level of the issued alarm is "Alarm" may be referred to as the "Alarm sound," the alarm sound outputted in the case where the importance level of the issued alarm is "Warning" may be referred to as the "Warning sound," and the alarm sound outputted in the case where the importance level of the issued alarm is "Caution" may be referred to as the "Caution sound." Note that, each of the radars 22 and 23 and the ECDISs 24 and 25 may be designed to output the alarm sound when the importance level is "Alarm" or "Warning", and does not output when the importance level is "Caution".

When the alarm determining module 32 determines that the alarm needs to be issued, the alarm sound output timing control module 33 controls the timing for the radar 22 itself to output the alarm sound based on the time acquired from the internal clock 36 described later.

The alarm sound outputting module 34 is connected with the buzzer 40. The alarm sound outputting module 34 outputs the alarm sound by operating the buzzer 40 at the timing controlled by the alarm sound output timing control module 33.

The memory 35 stores various kinds of information regarding the determination of the alarm and the control of the alarm sound. The examples of stored contents in the memory 35 include information, such as the criteria for the alarm determining module 32 to determine whether to issue the alarm and, in the case of issuing the alarm, determine the importance level of the alarm. Moreover, the memory 35 stores the information regarding the timing to issue the alarm, the timing controlled by the alarm sound output timing control module 33.

The internal clock 36 is a clock built in the radar 22 itself, and may be configured by using a crystal oscillator, for example.

The time synchronizing module 37 synchronizes the internal clock 36 of the radar 22 itself with an internal clock of the GPS navigation system 21.

To describe in detail, the GPS navigation system 21 includes the internal clock. Moreover, since the GPS navigation system 21 performs the GPS positioning, it can acquire extremely accurate GPS time (GNSS time). Therefore, the GPS navigation system 21 can keep the time of the internal clock 36 extremely accurate by suitably correcting the time of the internal clock 36 of the GPS navigation system 21 through using the GPS time.

An SNTP server using a known SNTP (Simple Network Time Protocol) operates in the GPS navigation system 21. On the other hand, the time synchronizing module 37 of the radar 22 operates as a known SNTP client and corrects error of the internal clock 36 of the radar 22. Specifically, the time synchronizing module 37 of the radar 22 accesses the GPS navigation system 21, calculates the error occurring between the internal clock 36 of the radar 22 and the internal clock of the GPS navigation system 21, and adjusts the time of the internal clock 36 of the radar 22 to eliminate the error. Thus, the internal clock 36 of the radar 22 can be kept extremely accurate by performing the accurate time synchronization between the internal clock 36 of the radar 22 and the internal clock of the GPS navigation system 21 (which is based on the extremely accurate GPS time).

Note that, the time synchronization is also performed for each of the other instruments 23 to 25 with the GPS navigation system 21. Thus, the times of the internal clocks 36 of the radars 22 and 23 and the ECDISs 24 and 25 are synchronized with the time (GPS time) of the internal clock of the GPS navigation system 21. Therefore, it can be said that the time synchronizing module 37 of the radar 22 also achieves the time synchronization among the other instruments 23 to 25 by performing the time synchronization with the GPS navigation system 21.

Here, the control of the alarm sound performed in the conventional instrument which informs the alarm is described. Specifically, once some sort of abnormality is detected in the conventional instrument, the conventional instrument immediately outputs the alarm sound. However, in a case where alarms are issued in a plurality of instruments, the alarm sounds are disorderly outputted by the plurality of instruments and overlap with each other, and the user may find it difficult to distinguish the kind of each alarm sound and the output source thereof.

Hereinafter, three specific examples of such a case where the user finds it difficult to distinguish the alarm sound are described.

The first example is a case where information detected by a single sensor is utilized by the plurality of instruments, and the output from the sensor cannot be obtained due to some sort of reason. In this case, the plurality of instruments utilizing the information from the sensor individually recognize their abnormalities and output the alarm sounds; however, each instrument has a different timing of detecting the abnormality and a different processing time length from the recognition of the abnormality until the output of the alarm sound, and therefore, the timing of outputting the alarm sound may slightly vary thereamong.

Figure 3:
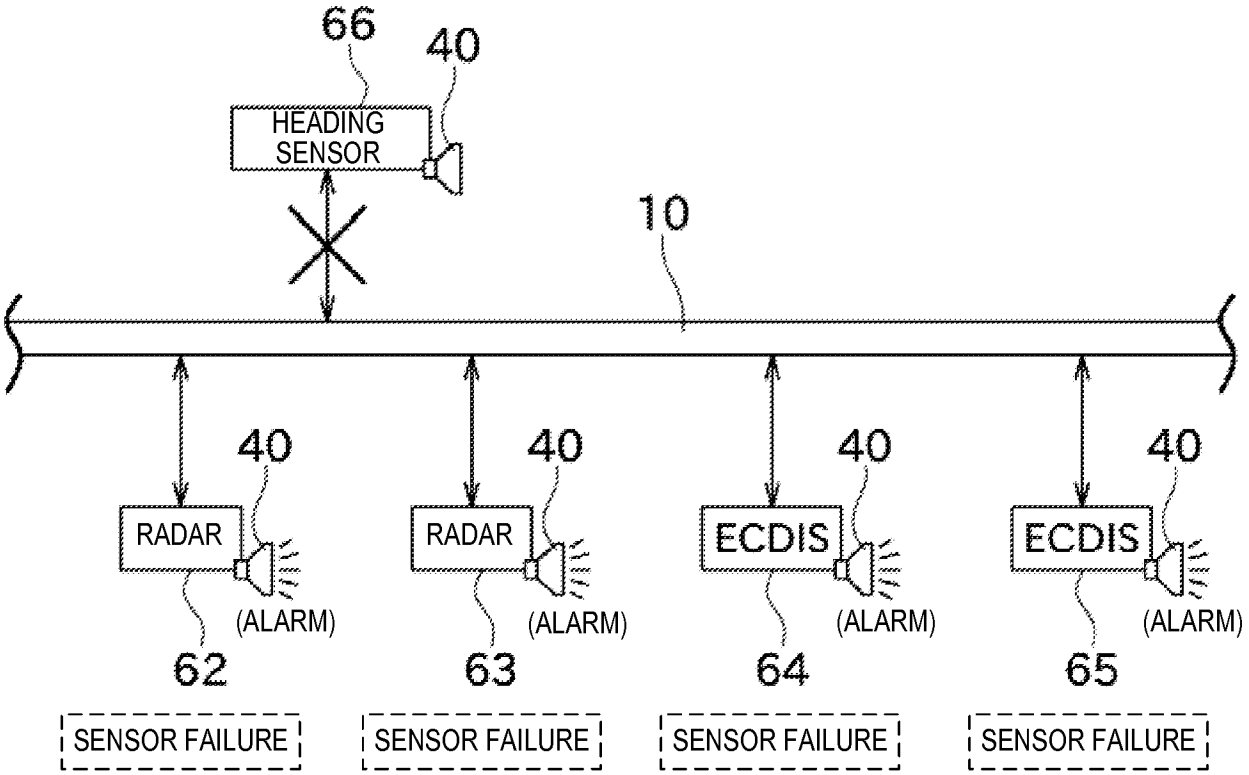
FIG. 3 (Conventional Art)
FIG. 3 is a schematic view for describing a situation where abnormality occurs in a sensor used for a plurality of instruments in a conventional configuration.

For example, as illustrated in FIG. 3, a system in which radars 62 and 63, ECDISs 64 and 65, and a heading sensor 66 are connected with the network 10 is considered. Note that, the heading sensor 66 includes a plurality of GPS antennas (not illustrated) and detects a heading at which the ship travels, by measuring phase differences among received GPS radio waves.

In the conventional system illustrated in FIG. 3, when an output of the heading sensor 66 cannot be acquired (e.g., due to network failure), the radars 62 and 63 and the ECDISs 64 and 65 issue the alarm "SENSOR FAILURE" and output the alarm sounds at independent timings to each other. In this case, the alarm sounds are outputted here and there, and it is difficult for the user to understand what occurred and where it occurred.

The second example is a case where an alarm is escalated in one or more of a plurality of instruments. Specifically, with the instruments which inform the alarms, when an alarm of a certain importance level is issued but a predetermined acknowledging operation (ACK: Acknowledgement) is not performed within a predetermined period of time from the issuance, an operation in which the importance level of the alarm may be raised to stimulate a closer attention (escalation) may be performed.

For example, a case where the information acquired by a sensor is utilized by the other plurality of instruments and abnormality occurs in the sensor is considered. Hereinafter, the instrument that utilizes the information from the sensor may be referred to as the "utilizing instrument."

When the abnormality occurs in the sensor, the sensor itself issues the alarm of a predetermined importance level, and the utilizing instrument which can no longer acquire the information from the sensor also issues the alarm of the same importance level.

In this situation, when the ACK operation is not performed to the sensor or the utilizing instrument by the user, the following two kinds of operations can be considered: an operation in which both of the sensor and the utilizing instrument escalates, and an operation in which only the utilizing instrument escalate. When only the utilizing instrument escalates, there is a possibility that the sensor and the utilizing instrument simultaneously output, for a single alarm, alarm sounds of different importance levels.

Figure 4:
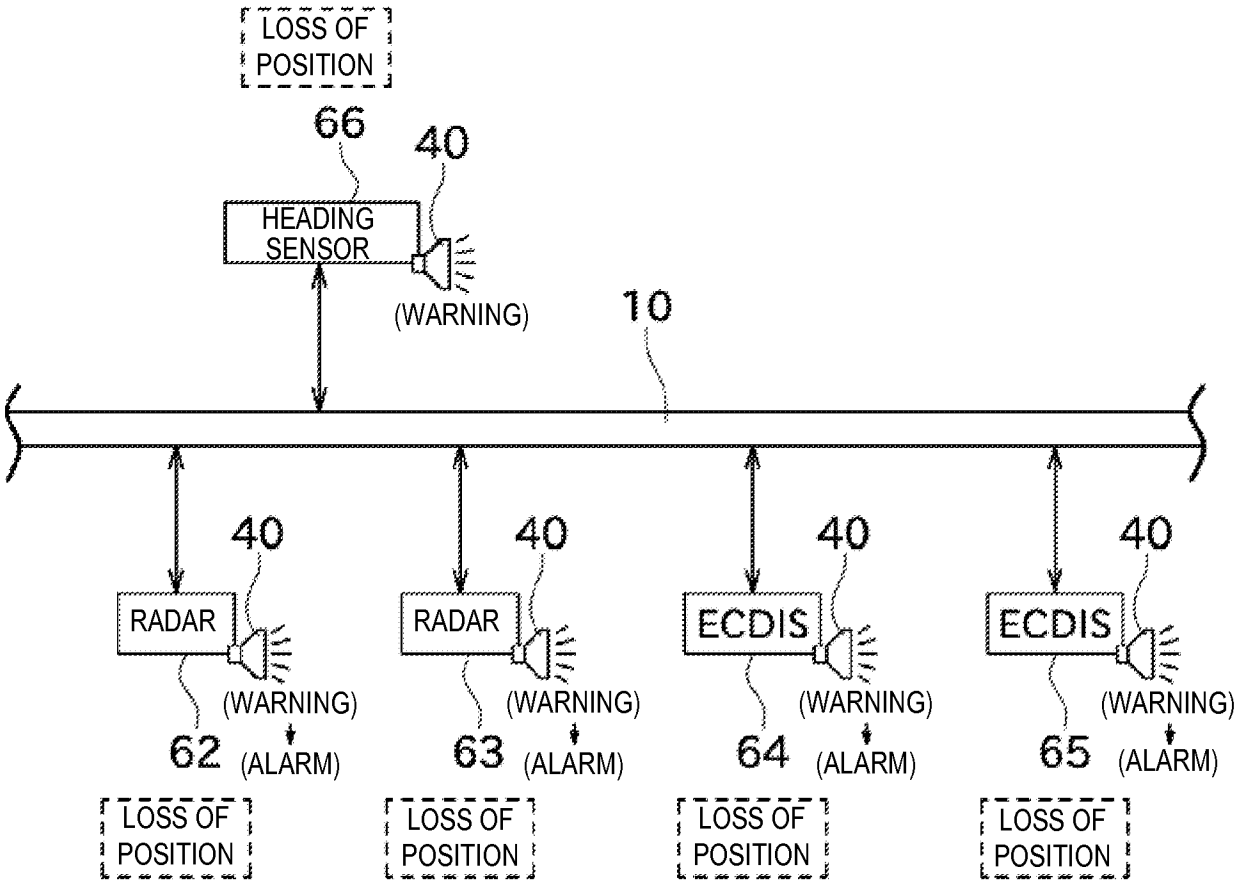
FIG. 4 (Conventional Art)
FIG. 4 is a schematic view for describing a situation where alarms are escalated in some of the plurality of instruments in the conventional configuration.

For example, with a system having the same conventional configuration as the system in FIG. 3, a case where a situation "LOSS OF POSITION" indicating that the GPS positioning cannot be performed occurs in the heading sensor 66 as illustrated in FIG. 4 is considered. Since it is determined to issue the alarm of which the importance level is "Warning" in this situation (LOSS OF POSITION), the heading sensor 66 outputs the Warning sound and the radars 62 and 63 and the ECDISs 64 and 65 also output the Warning sound. When the ACK operation is not performed on the "Warning" alarm even after the predetermined time period, the radars 62 and 63 and the ECDISs 64 and 65 which are the utilizing instruments escalate the importance level of the alarm to "Alarm" and output the Alarm sounds. On the other hand, in the heading sensor 66, since the importance level of the alarm remains "Warning," the Warning sound is kept outputted. In this case, it is difficult for the user to grasp the kind of the issued alarm.

The third example is a case where alarms of different importance levels are simultaneously issued in a plurality of instruments. Specifically, in the instruments which inform alarms, criteria for determining the alarm which should be preferentially informed among the alarms may be different in each instrument depending on the application and purpose. Therefore, when the alarms of different importance levels are substantially simultaneously issued in the respective instruments, there is a case where one of the plurality of alarm informing devices informs the alarm of the comparatively higher importance level among the alarms and a different one of the plurality of alarm informing devices informs the alarm of the comparatively lower importance level.

Figure 5:
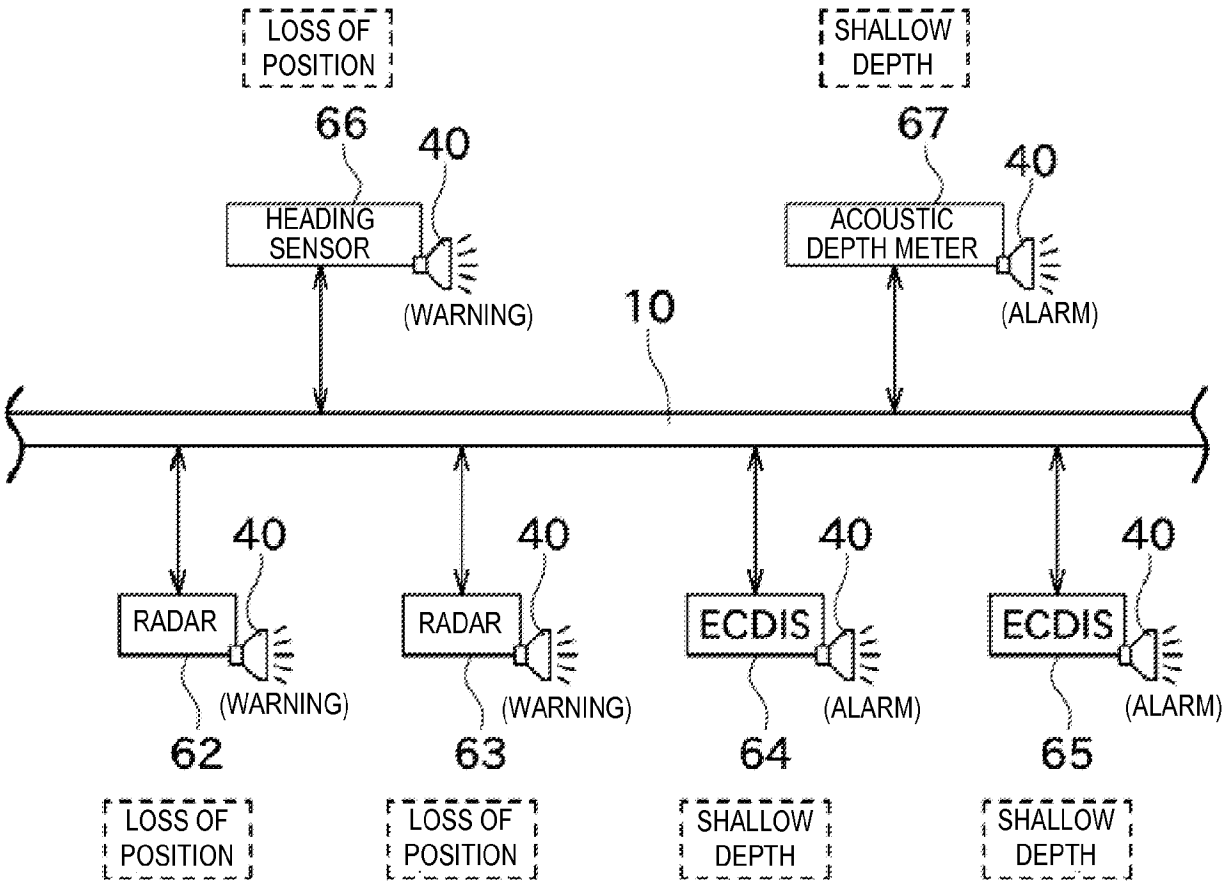
FIG. 5 (Conventional Art)
FIG. 5 is a schematic view for describing a situation where different alarm sounds are simultaneously outputted in the conventional configuration.

For example, as illustrated in FIG. 5, a system in which the radars 62 and 63, the ECDISs 64 and 65, the heading sensor 66, an acoustic depth meter 67 are connected with the network 10 is considered. Note that, the acoustic depth meter 67 discharges an acoustic wave from a bottom of the ship and detects a water depth by measuring a period of time from the discharge of the acoustic wave until it returns back after reflecting on the seabed.

With the system having the conventional configuration in FIG. 5, a case where a situation "LOSS OF POSITION" indicating that GPS positioning cannot be performed occurs in the heading sensor 66 and, substantially simultaneously, a situation "SHALLOW DEPTH" indicating that the detected water depth is shallower than a predetermined value occurs in the acoustic depth meter 67 is considered. In this example, the importance level of the alarm to be issued in "LOSS OF POSITION" is determined to be "Warning" and the importance level of the alarm to be issued in "SHALLOW DEPTH" is determined to be "Alarm."

In this case, the Warning sounds for "LOSS OF POSITION" are outputted from the heading sensor 66 and the radars 62 and 63 using information of the heading sensor 66, and the Alarm sounds of "SHALLOW DEPTH" are outputted from the acoustic depth meter 67 and the ECDISs 64 and 65 using information of the acoustic depth meter 67. Therefore, it is difficult for the user to distinguish the alarm sound at high importance level among the plurality of alarm sounds.

In this regard, the alarm informing devices of this disclosure solve the disadvantages described above, and the alarms can be informed to the user in an easily understandable manner. Hereinafter, the instruments 22 to 25 which are the alarm informing devices in this embodiment are described in detail; however, prior to this, a method of informing the plurality of alarm sounds to the user by dividing them into time frames (hereinafter, referred to as the time slot method) is described.

Figure 6:
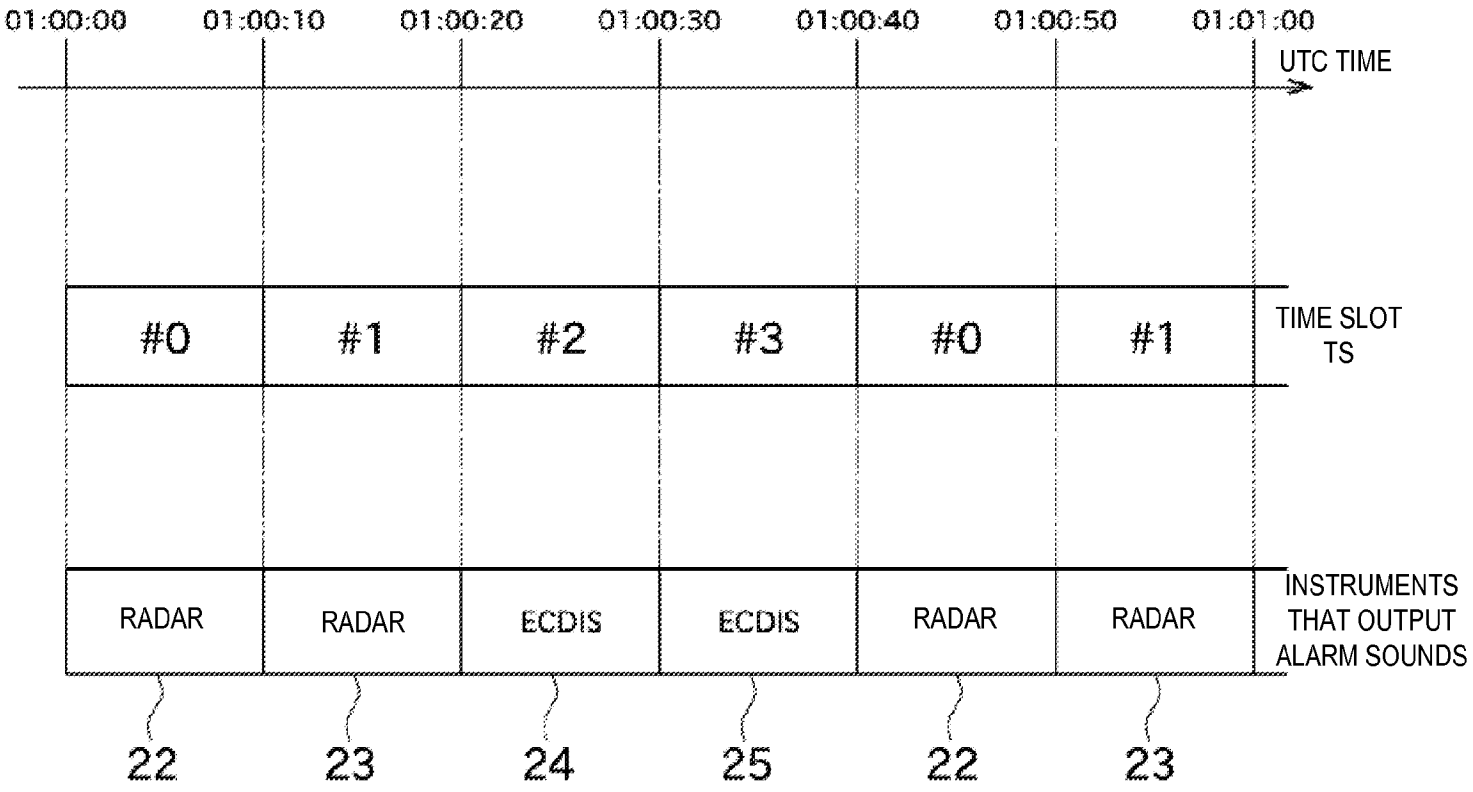
FIG. 6 is a view illustrating time slots and assignment thereof.

In this embodiment, the time slot is a time frame created by evenly dividing a time range periodically repeated, and in the example of FIG. 6, four time frames obtained through dividing a time range of forty seconds by ten seconds are defined. The four time frames (time slots) are repeated every forty seconds. Each of the instruments 22 to 25 outputs the alarm sound only within the time frame assigned thereto.

In FIG. 6, a case where some sort of abnormality is simultaneously detected by the four instruments 22 to 25 at the moment that the time turns 01:00:00, and the alarm sounds need to be outputted is considered. In this case, the radar 22 outputs the alarm sound between 01:00:00 and 01:00:10 (here, the other instruments 23 to 25 do not output the alarm sounds). When the time reaches 01:00:10, the alarm sound of the radar 22 stops, and the radar 23 alternatively outputs the alarm sound from 01:00:10 to 01:00:20. Thus, the instruments 22 to 25 issuing the alarms only output the alarm sounds within the time frames assigned to the respective instruments, and do not output the alarm sounds outside of the time frames.

Subsequently, the outputs of the alarm sounds by the respective instruments in the time slot method are described in detail.

Although any pattern of outputting and stopping the alarm sounds of the respective importance levels may be adopted, in this embodiment, the Alarm sound is defined to be outputted three times in one cycle. A single output is performed for a short period of time and a single cycle is ten seconds the longest. Moreover, in this embodiment, the time slots are allocated in a chronological order as follows: the time slot of the radar 22, the time slot of the radar 23, the time slot of the ECDIS 24, and the time slot of the ECDIS 25. Therefore, in a situation where the four instruments 22 to 25 are required to output the Alarm sounds, although the first instrument to output the Alarm sound among the four instruments 22 to 25 depends on the issued timing of the first alarm, the Alarm sound is outputted one by one, for example, the radar 23 outputs the alarm sound after the radar 22, the ECDIS 24 outputs the alarm sound after the radar 23, the ECDIS 25 outputs the alarm sound after the ECDIS 24, and the radar 22 outputs the alarm sound after the ECDIS 25.

Therefore, until the acknowledging operation for the plurality of alarms by the user is performed, the alarm sounds are outputted cyclically, such as the radar 22, the radar 23, the ECDIS 24, the ECDIS 25, the radar 22, . . . , while the instruments 22 to 25 cooperate with each other. Thus, only the alarm sound of one of the instruments is outputted in a single time frame even when the plurality of alarms are issued. Therefore, the user can clearly distinguish the individual alarm sounds without being interrupted by noises.

Note that, each of the instruments 22 to 25 controls the timing of outputting the alarm sound with reference to the internal clock 36 provided thereto, and the time of the internal clock 36 is accurately synchronized with the times of the internal clocks 36 of the other instruments by the time synchronizing module 37. Therefore, each of the instruments 22 to 25 can sequentially output the alarm sounds without overlapping the output timings thereof highly accurately.

The memory 35 of each of the instruments 22 to 25 stores the information regarding the timing of outputting the alarm sound of the corresponding instrument in association with the other instruments, specifically, the information for specifying the time slot assigned to the corresponding instrument. In this embodiment, the information for specifying the time slot is a number denoted to the corresponding time slot (the number with # in FIG. 6). Therefore, the memory 35 of the radar 22 stores #0 as the number of its time slot, and the memory 35 of the radar 23 stores #1.

Although each of the time slots may be assigned to any of the instruments, the user can easily respond if the instruments with similar functions or close installation locations are assigned to the time slots chronologically close to each other.

Next, the specific calculations of the time slots are described.

Each time slot is calculated by the alarm sound output timing control module 33 provided to each of the instruments 22 to 25. Specifically, when the number of instruments with the possibility of outputting the alarm sound among the instruments 22 to 25 is N, a period of time required to output the alarm sound once is ONtime, and a current time point acquired from the internal clock 36 (elapsed seconds from a predetermined time point) is UTC-time, TS that is a value indicating the number of the current time slot is calculated based on the following equation: TS=mod(int (UTCtime/ONtime), N). Here, mod(X, Y) is a remainder that is found by dividing X by Y, and int(Z) is an integer obtained by truncating the floating point number of Z.

The alarm sound output timing control module 33 of each of the instruments 22 to 25 outputs the alarm sound when the number of the time slot assigned to the corresponding instrument and stored in the memory 35 is equivalent to the value of TS calculated as above. By the timing control, the time frames in which the alarm sounds of the instruments 22 to 25 are outputted are suitably assigned and each of the instruments 22 to 25 can output the alarm sound after standing by until the corresponding timing. Note that, the above calculation method is merely an example, and other calculation method may also be used.

As described above, the radar 22 (similar for the radar 23 and the ECDISs 24 and 25) configuring the alarm informing system 1 of this embodiment receives the information of the position of the ship from the GPS navigation system 21 and informs the alarm to the user when either one of failure in the GPS navigation system 21 and error in the reception of the information from the GPS navigation system 21 occurs. Further, the radar 22 includes the time synchronizing module 37, the alarm sound output timing control module 33, and the buzzer 40. It will be appreciated that the radar 22 includes a processor configured to execute the time synchronizing module 37, the alarm sound output timing control module 33, and the alarm sound outputting module 34 as software. The time synchronizing module 37 synchronizes the internal clock 36 of the radar 22 with the internal clocks 36 of the other instruments 23 to 25. The alarm sound output timing control module 33 controls the timing of outputting the alarm sound when the alarm is issued, based on the internal clock 36 of the radar 22. The buzzer 40 outputs the alarm sound at the timing controlled by the alarm sound output timing control module 33.

Thus, the radar 22 can accurately control the timing of outputting the alarm sound for informing the alarm to the user, in association with the other instruments 23 to 25 with reference to the synchronized time. Therefore, for example, even when the alarms are simultaneously issued in the plurality of instruments 22 to 25, the timings of outputting the alarm sounds can be adjusted among the instruments 22 to 25. Thus, alarms can be informed to the user in the instinctively easily-understandable manner.

Figure 7:
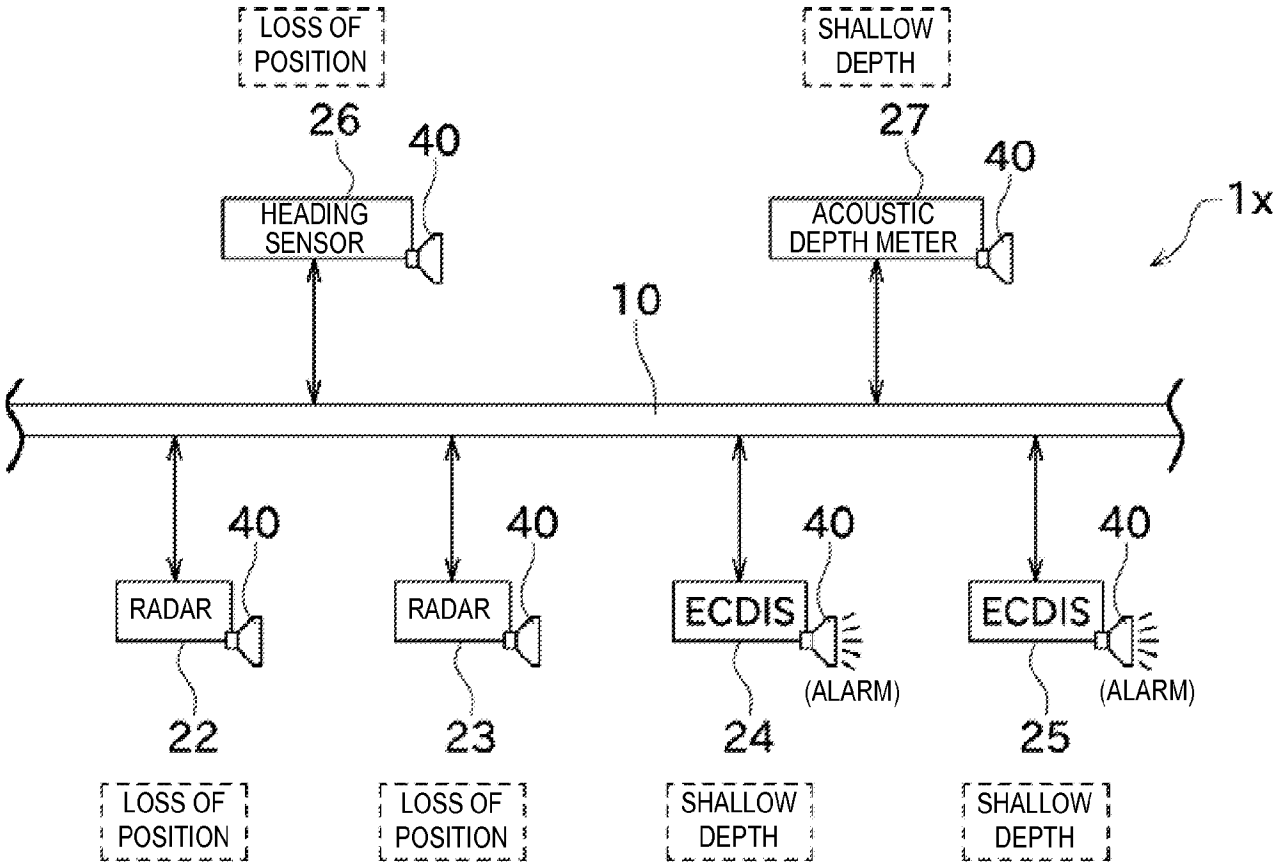
FIG. 7 is a schematic view illustrating a situation of where a plurality of instruments of an alarm informing system output Alarm sounds, according to a second embodiment.
Figure 8:
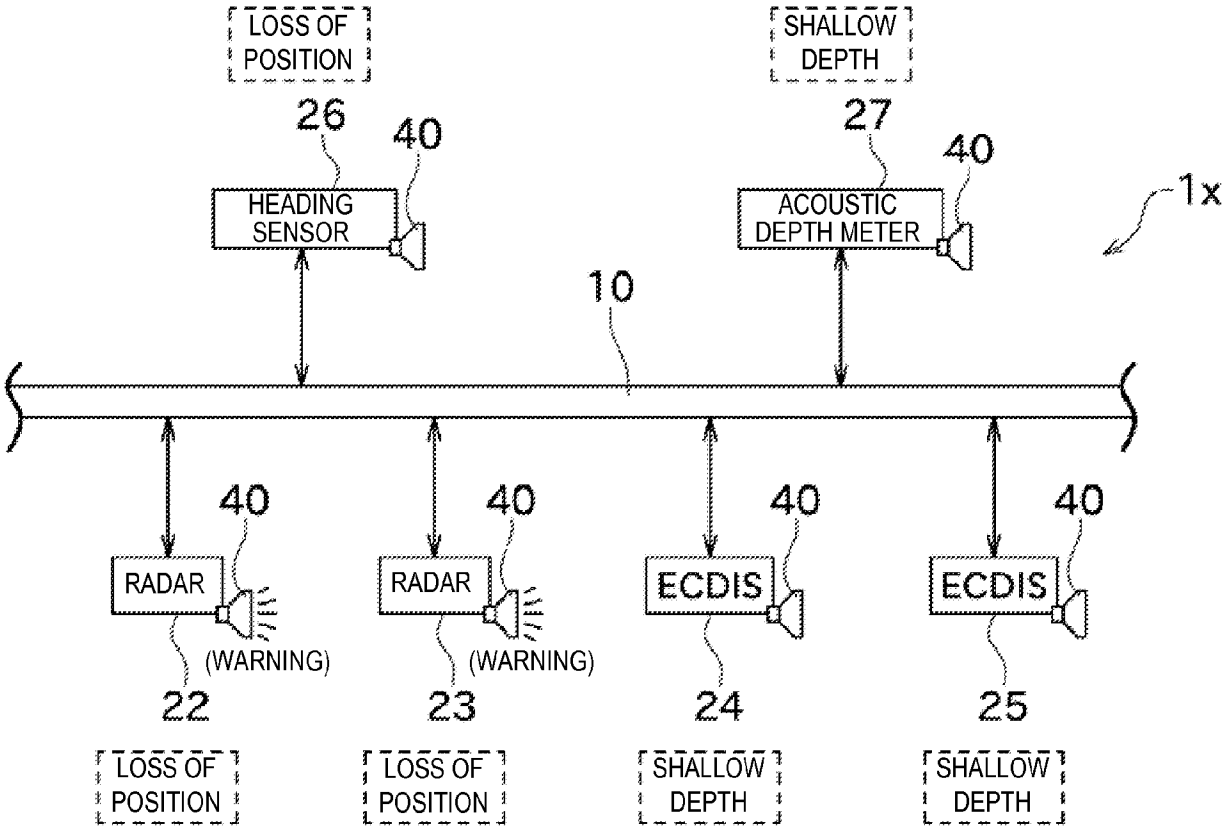
FIG. 8 is a schematic view illustrating a situation where the plurality of instruments output Warning sounds.

Next, a second embodiment of this disclosure is described. FIG. 7 is a schematic view illustrating a situation where a plurality of instruments 24, 25 and 27 of an alarm informing system 1*x* output the Alarm sounds, according to the second embodiment. FIG. 8 is a schematic view illustrating a situation where the plurality of instruments 22, 23 and 26 output the Warning sounds. Note that, in the description regarding the second embodiment and embodiments thereafter, the same reference numerals are denoted in the drawings to the components same as or similar to the first embodiment, and the description thereof may be omitted.

As illustrated in FIG. 7, the alarm informing system 1*x* of this embodiment includes a heading sensor 26, an acoustic depth meter 27, the radars 22 and 23, and the ECDISs 24 and 25. The components of this embodiment correspond to the conventional configuration in FIG. 5. Note that, the radars 22 and 23 and the ECDISs 24 and 25 of this embodiment are different from those of the configuration in FIG. 5 in terms that each of them has a configuration for the alarm sound timing control illustrated in FIG. 2.

In this embodiment, the heading sensor 26 acquires the GPS time and corrects an internal clock provided thereto. An SNTP server operates in the heading sensor 26, and the internal clocks 36 of the other instruments 22 to 25 and 27 are synchronized with the accurate internal clock as described above.

In the alarm informing system 1*x* of this embodiment, instead of assigning the time slot number for every instrument as the first embodiment described above, the time slot number is assigned for every importance level of the alarm. Specifically, three time slots are prepared. When the importance level of the alarm is "Alarm," the time slot #0 is assigned, when the importance level of the alarm is "Warning," the time slot #1 is assigned, and when the importance level of the alarm is "Caution," the time slot #2 is assigned.

Thus, when the instruments are required to output the alarm sounds of the equivalent importance level to each other, they output the alarm sounds at the same timing. For example, as illustrated in FIG. 7, a case is considered, where the "Alarm" is issued in the acoustic depth meter 27 and the acoustic depth meter 27 and the ECDISs 24 and 25 need to output the Alarm sounds, and at the same time, the Warning is issued in the heading sensor 26 and the heading sensor 26 and the radars 22 and 23 need to output the Warning sounds. In this case, a state where the ECDISs 24 and 25 simultaneously output the Alarm sounds and the radars 22 and 23 do not output the alarm sounds (FIG. 7), and a state where the radars 22 and 23 simultaneously output the Warning sounds and the ECDISs 24 and 25 do not output the alarm sounds (FIG. 8) are alternately repeated.

Therefore, at least in the radars 22 and 23 and the ECDISs 24 and 25, by outputting the alarm sounds in the organized manner based on the importance level, the noisiness toward the user can be effectively reduced and the user can be stimulated to respond suitably without discomfort.

Note that, in the above control, since the importance level of the first alarm to be outputted depends on the issued timing of the first alarm, the Caution sound indicating the low importance level may be the first output. To avoid such a case, a control of skipping the time slot #1 once for the Warning sound and skipping the time slot #2 twice for the Caution sound, and then outputting the alarm sounds can be considered. According to this control, the outputting order of the alarm sounds can be secured to be the Alarm sound, the Warning sound, and then the Caution sound. Therefore, the user can acknowledge from the alarm of the high importance level first and respond to it.

Figure 9:
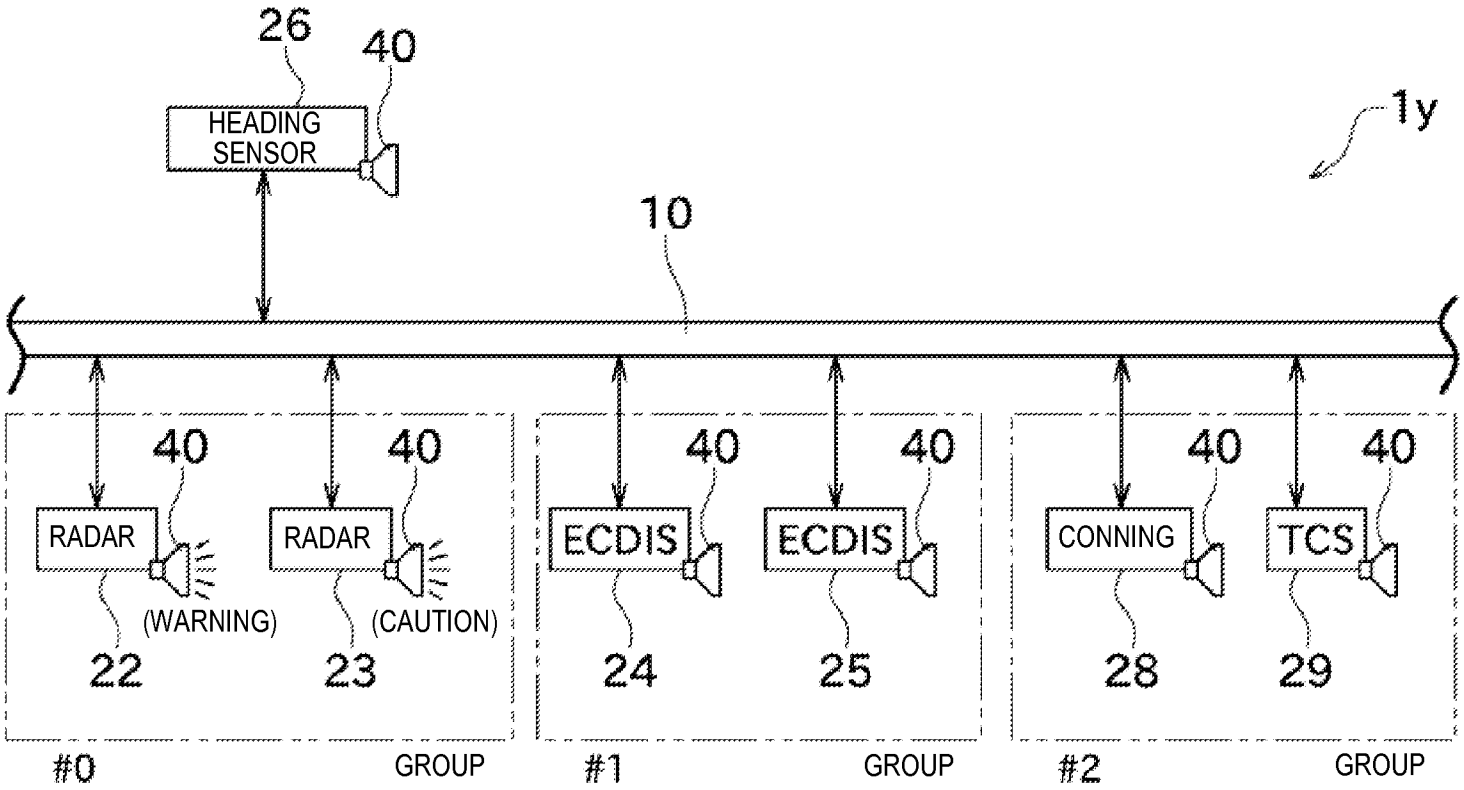
FIG. 9 is a schematic view of an alarm informing system according to a third embodiment.

Next, a third embodiment is described. FIG. 9 is a block diagram illustrating an alarm informing device group of the third embodiment.

As illustrated in FIG. 9, an alarm informing system 1*y* of this embodiment includes the radars 22 and 23, the ECDISs 24 and 25, the heading sensor 26, a conning 28, and a traction control system (TCS) 29.

The conning 28 is a centralized monitoring display unit configured to display the various kinds of information regarding the ship and the like in an organized manner. The traction control system 29 automatically controls the ship to remain within a predetermined course.

Each of the instruments 22 to 25, 28 and 29 has a configuration for the alarm sound timing control illustrated in FIG. 2.

In the alarm informing system 1*y* of this embodiment, a common time slot number is assigned to a plurality of instruments having similar functions to each other, as needed. Specifically, three time slots are prepared. As illustrated in FIG. 9, the time slot #0 is assigned to the two radars 22 and 23, the time slot #1 is assigned to the two ECDISs 24 and 25, and the time slot #2 is assigned to the conning 28 and the traction control system 29.

Thus, for example, when the alarm of "Warning" is issued in the radar 22 and the alarm of "Caution" is issued in the radar 23 substantially at the same time, the Warning sound of the radar 22 and the Caution sound of the radar 23 are simultaneously outputted in the time slot #0. Although two kinds of alarm sounds are outputted simultaneously, since only the two instruments of the same kind output the alarm sounds and the timings of starting the outputs can also be matched with each other, the sounds are not excessively noisy to the user.

Since the alarm sounds are outputted in the organized manner per instrument group having similar functions to each other as above, the user can easily determine the kinds of the instruments where the alarms are issued. Moreover, since the alarm sounds of the plurality of instruments can be outputted in a single time slot, the number of the time slots which need to be prepared can be smaller. Therefore, even if the number of the instruments configuring the alarm informing system 1*y* is increased, the waiting time length of each instrument before outputting the alarm sound does not easily become long.

Note that, any method may be adopted to determine the plurality of instruments to be assigned with the common time slot. For example, it can be considered to assign the common time slot to a group of the instruments installed physically close to each other.

Moreover, the instruments 22 to 25, 28 and 29 may have a group management function to manage a group formed of two or more of the plurality of instruments, and may associate information of identifying the group (e.g., a group ID) with the time slot number. Thus, the timing of outputting the alarm sound can easily be set for every group.

Figure 10:
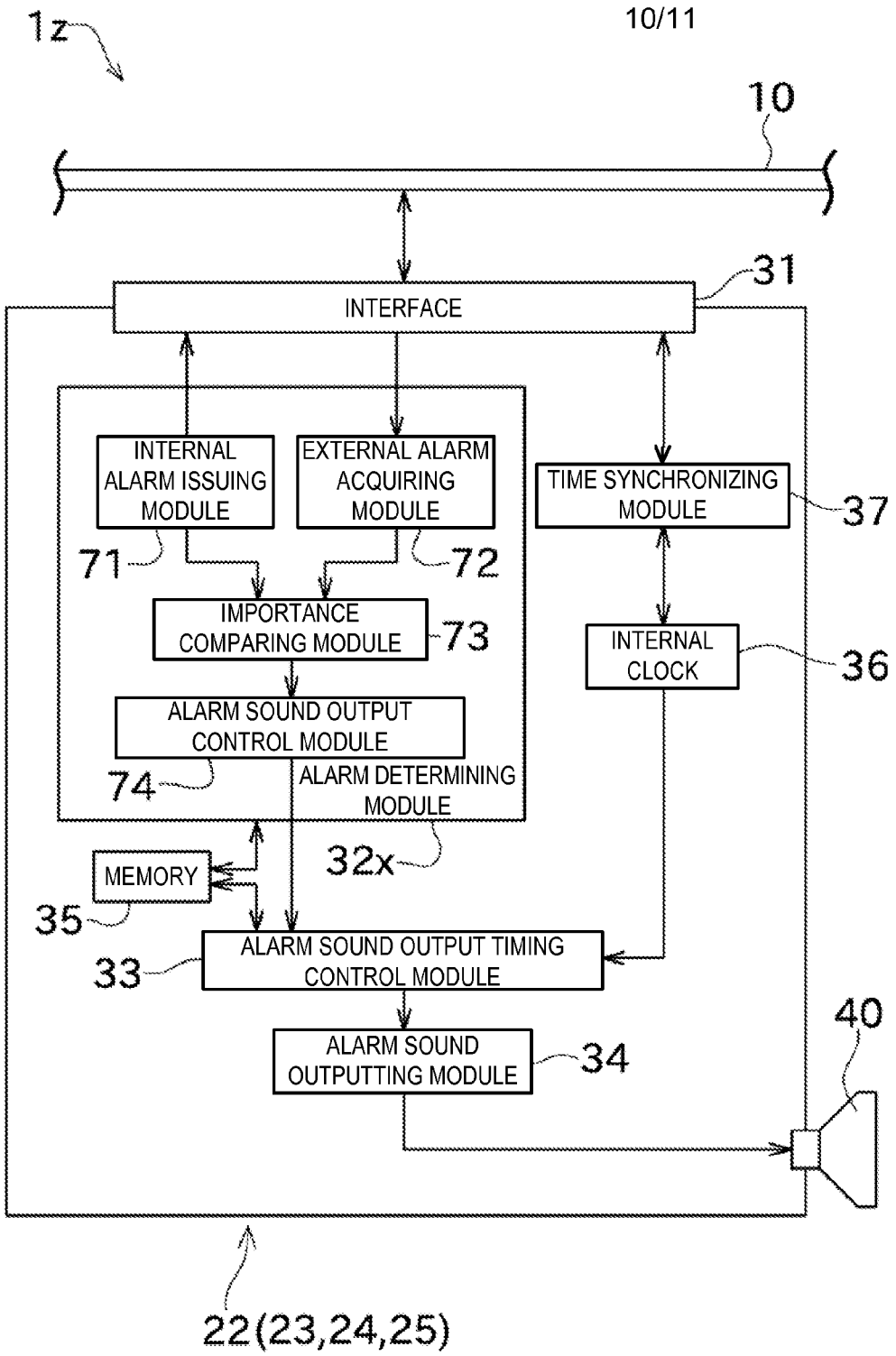
FIG. 10 is a block diagram illustrating a configuration for a control of alarm sounds outputted from instruments, in an alarm informing system according to a fourth embodiment.

Next, a fourth embodiment is described. FIG. 10 is a block diagram illustrating an alarm informing device provided in an alarm informing system 1*z* of the fourth embodiment.

Instruments configuring the alarm informing system 1*z* of this embodiment are similar to the instruments 21 to 25 in FIG. 1. Note that, this embodiment is different from the above embodiments in that an alarm determining module 32*x* provided to each of the radars 22 and 23 and the ECDISs 24 and 25 compares the importance level of the alarm of the corresponding instrument with the other instruments.

Hereinafter, the configuration of the radar 22 is described to represent the radars 22 and 23 and the ECDISs 24 and 25. As illustrated in FIG. 10, the radar 22 includes the interface 31, the alarm determining module 32*x*, the alarm sound output timing control module 33, the alarm sound outputting module 34, the memory 35, the internal clock 36, and the time synchronizing module 37. As in the previous embodiment, it will be appreciated that the radar 22 includes a processor configured to execute the alarm determining module 32*x*, the alarm sound output timing control module 33, the alarm sound outputting module 34, and the time synchronizing module 37 as software.

The alarm determining module 32*x* includes an internal alarm issuing module 71, an external alarm acquiring module 72, an importance comparing module 73, and an alarm sound output control module 74.

The internal alarm issuing module 71 observes the state of the radar 22 itself and issues an alarm when a predetermined condition is satisfied. As the condition for issuing the alarm, similar to the above embodiments, for example, the case where some sort of abnormality occurs in the radar 22 itself or the case where the information which is supposed to be received by the radar 22 from the other instruments 21, 23, 24 and 25 is not received can be considered.

When one or more alarms are issued in the radar 22, the internal alarm issuing module 71 creates alarm information including the contents of the alarm and the importance level of the alarm, for each issued alarm. Then the internal alarm issuing module 71 transmits the alarm information to the other instruments 23 to 25 via the interface 31. Moreover, the alarm information is also outputted to the importance comparing module 73 (described later) from the internal alarm issuing module 71.

Note that, there is a case where the importance level or contents of the alarm is changed by the escalation or the ACK operation described above. When the alarm is changed, the internal alarm issuing module 71 newly creates the alarm information every time the alarm is changed, and outputs it to the other instruments 23 to 25 and the importance comparing module 73.

The external alarm acquiring module 72 receives, via the interface 31, the alarm information transmitted from the internal alarm issuing modules 71 of the other instruments 23 to 25, and acquires the details of the alarms issued in the other instruments 23 to 25. The alarm information is outputted from the external alarm acquiring module 72 to the importance comparing module 73 (described later).

Based on the alarm information from the internal alarm issuing module 71, the importance comparing module 73 updates a list of the alarms currently issued in the radar 22. Each alarm currently issued in the radar 22 is stored in the memory 35. Hereinafter, this alarm may be referred to as the internal alarm. Moreover, based on the alarm information from the external alarm acquiring module 72, the importance comparing module 73 updates a list of the alarms currently issued in the other instruments 23 to 25. Each alarm currently issued in the other instruments 23 to 25 is stored in the memory 35. Hereinafter, this alarm may be referred to as the external alarm hereinafter.

Further, the importance comparing module 73 acquires the most important internal alarm (the internal alarm of the highest importance level) in the list and the most important external alarm (the external alarm of the highest importance level) in the list by suitably processing the internal and external alarm lists stored in the memory 35. Note that, although any processing for the acquisition may be adopted, for example, sorting of the alarms with reference to the importance level can be considered. When the number of internal alarms is one, the issued alarm becomes the most important internal alarm as it is. When the number of external alarms is one, the issued alarm becomes the most important external alarm as it is. The importance comparing module 73 compares the internal alarm of the highest importance level with the external alarm of the highest importance level. The comparison result is outputted to the alarm sound output control module 74.

When the importance level of the most important internal alarm is higher than or equivalent to the most important external alarm, the alarm sound output control module 74 allows the buzzer 40 of the radar 22 to output the alarm sound. In other cases, the alarm sound output control module 74 prohibits the output of the alarm sound. The control result of the alarm sound output control module 74 (the determination result of the alarm determining module 32*x*) is outputted to the alarm sound output timing control module 33.

The alarm sound output timing control module 33 controls the timing for the radar 22 itself to output the alarm sound from the buzzer 40 in the time slot method, similar to the first embodiment described above. The other configurations (the interface 31, the alarm sound outputting module 34, the internal clock 36, and the time synchronizing module 37) are similar to the above embodiments.

Hereinafter, the processing of determining whether to output the alarm sound, which is performed by the alarm determining module 32*x* of the radar 22 of this embodiment is described with reference to the flowchart in FIG. 11.

Figure 11:
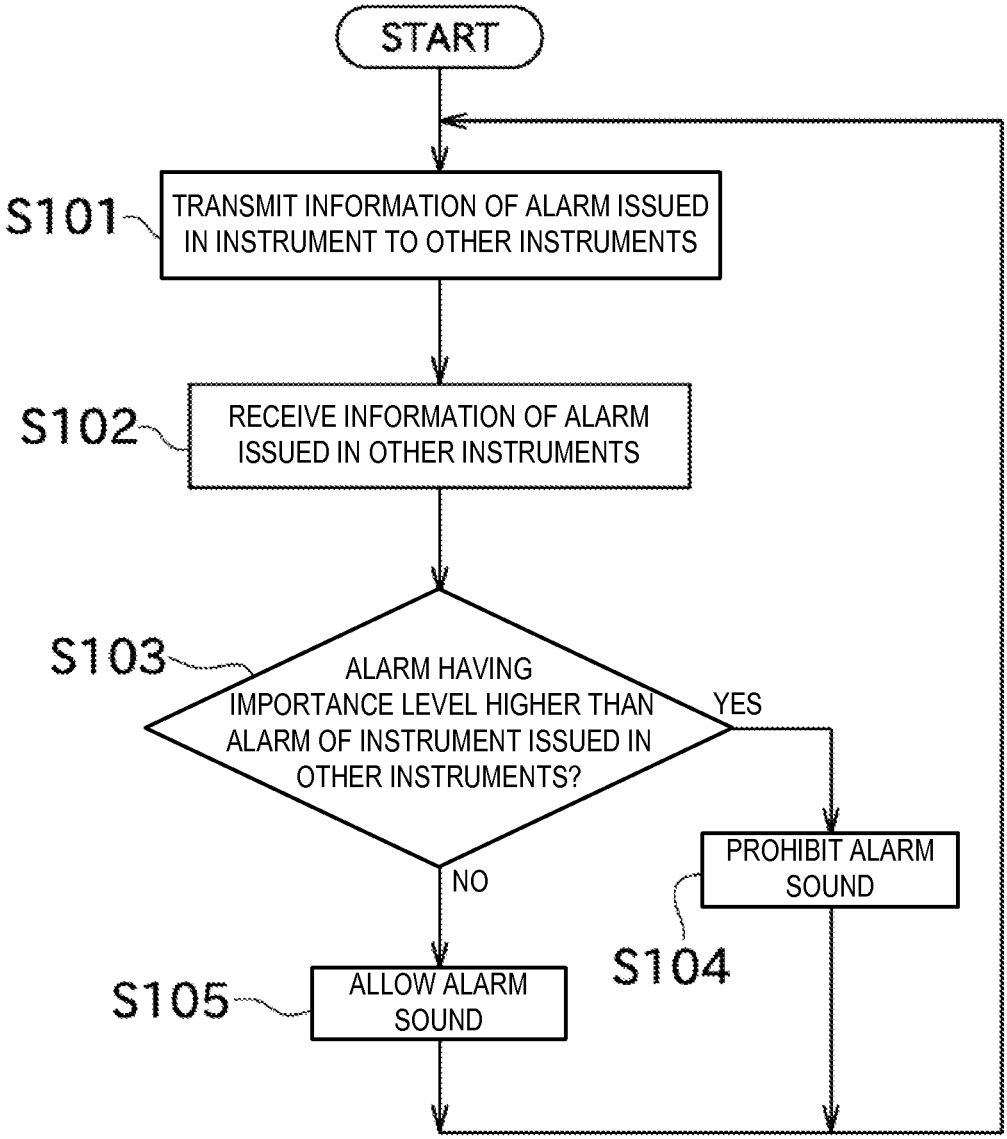
FIG. 11 is a flowchart illustrating processing of an alarm determining module according to the fourth embodiment.

As illustrated in FIG. 11, when the alarm is issued in the radar 22, the alarm determining module 32*x* of the radar 22 creates the alarm information including the importance level of the alarm and outputs it to the other instruments 23 to 25 via the interface 31 (the network 10) (S101). Moreover, the alarm determining module 32*x* receives, via the interface 31 (the network 10), the alarm information transmitted from the other instruments 23 to 25 (S102). Further, the importance level of the alarm of the radar 22 is compared with the importance level of the alarms of the other instruments 23 to 25 (S103), and if at least one of the alarms of the other instruments 23 to 25 has a higher importance level than the alarm of the radar 22, the output of the alarm sound is prohibited (S104), and if all of the alarms of the other instruments 23 to 25 do not have a higher importance level than the alarm of the radar 22, the output of the sound alarm is allowed (S105).

With this configuration, when at least one of the other instruments 23 to 25 issues the alarm of higher importance level than the radar 22, the radar 22 is controlled not to output the alarm sound. Therefore, even when a plurality of alarms are simultaneously issued in the plurality of instruments 22 to 25, the alarms can sequentially be informed to the user in the order from the alarm of the highest importance level. A situation where the user gets confused by sudden overlapped outputs of the multiple alarm sounds can be prevented and the user can sequentially acknowledge from the alarm of the highest importance level by simply following the order of the alarm sound outputs.

Although the preferred embodiments of this disclosure are described, the above configurations may be modified as follows, for example.

The time of the internal clock 36 of each of the instruments 22 to 25 is not limited to be synchronized with the GPS time, and may be synchronized with a different reference time. For example, a time distribution server configured to distribute a reference time may be connected with the network 10 and each internal clock 36 may be synchronized with the time of the time distribution server. Note that, to match the timings of the plurality of instruments 22 to 25 with each other, only the internal clocks 36 of the respective instruments 22 to 25 are required to be synchronized with each other, and the time of each internal clock 36 (the time of the time distribution server) does not necessarily have to be accurate.

The time synchronizing module 37 of one of the radars 22 and 23 and the ECDISs 24 and 25 may operate as the SNTP server and the time synchronizing modules 37 of the rest of the instruments may operate as the SNTP clients to perform direct time synchronization among the instruments 22 to 25. Moreover, the method of the time synchronization is not limited to SNTP, and for example, NTP (Network Time Protocol) may be utilized or a different protocol may be utilized.

In the above embodiments, the time slot method is adopted to sort the respective time periods in which the instruments 22 to 25 output the alarm sounds. Without limiting to this, for example, it may be modified such that once an alarm sound is outputted and some sort of acknowledging operation by the user is performed on the alarm corresponding to the alarm sound, the alarm sound of the next instrument is outputted. In this case, information regarding the order of the instruments to output the alarm sounds may be stored in the memory 35.

A configuration may also be adopted, in which a server configured to control all the timings of outputting the alarm sounds of the plurality of instruments is connected with the network 10, manages the alarms of the instruments 22 to 25, and controls the timings of outputting the alarm sounds. However, in this case, the respective instruments may not be able to output the alarm sounds if failure occurs in the server. Therefore, in this regard, the instruments 22 to 25 preferably control their alarm sound timings independently to each other as the above embodiments.

As the sound outputter configured to aurally inform the alarm to the user, instead of the buzzer 40 described above, a chime or a speaker may be used.

As the sensor, alternative to or in addition to the GPS navigation system 21, the heading sensor 26, and the acoustic depth meter 27 in the above embodiments, a radar sensor, a Doppler sonar, a wireless communication device, and/or an automatic identification system (AIS) may be connected with the network 10. The examples of the wireless communication system include a VHF radio and a satellite communication device.

The alarm informing systems 1, 1x , 1y and 1z of the above embodiments are not limited to be installed in the ship, and are also applicable to cases where a plurality of instruments configured to output the alarm sounds are installed in other movable body or a stationary facility.

In the foregoing specification, specific embodiments of the present disclosure have been described. However, one of ordinary skill in the art appreciates that various modifications and changes can be made without departing from the scope of the present disclosure as set forth in the claims below. Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims. The disclosure is defined solely by the appended claims including any amendments made during the pendency of this application and all equivalents of those claims as issued.

What is claimed is:

1. An alarm informing device for receiving detection information from one or more sensors and informing an alarm to a user when either one of failure in the one or more sensors and error in the reception of the information from the one or more sensors occurs, the alarm informing device comprising:

a processor configured to execute:

a time synchronizing module configured to synchronize an internal clock of the alarm informing device with an internal clock of another alarm informing device; and an alarm sound output timing control module configured to control a timing of outputting an alarm sound when the alarm is issued, based on the internal clock of the alarm informing device; and a sound outputter configured to output the alarm sound at the timing controlled by the alarm sound output timing control module, the sound outputter being one of a buzzer, a chime, or a speaker, wherein the alarm informing device is either one of a radar and an electronic nautical chart information display system.

2. The alarm informing device of claim 1, further comprising a memory configured to store information regarding the timing of outputting the alarm sound from the alarm informing device, the timing being in association with the other alarm informing device, wherein the alarm sound output timing control module controls the timing of the alarm sound output based on the stored information.

3. The alarm informing device of claim 2, wherein as the information regarding the timing of outputting the alarm sound from the alarm informing device, the memory stores information for specifying a time frame assigned with the alarm informing device among a plurality of time frames prepared as candidates for outputting the alarm sounds therewithin.

4. The alarm informing device of claim 2, wherein the timing of outputting the alarm sound of the alarm informing device is controlled to match with a timing of outputting an alarm sound of the other alarm informing device when the alarm informing device is categorized in the same group with the other alarm informing device.

5. The alarm informing device of claim 1, further comprising:

an interface configured to transmit information regarding importance of the alarm issued in the alarm informing device and receive information regarding importance of the alarm issued in the other alarm informing device, wherein the processor is further configured to execute an alarm sound output control module configured to control the alarm sound of the alarm informing device not to be outputted when the importance of the alarm issued in the other alarm informing device is higher than that of the alarm issued in the alarm informing device.

6. The alarm informing device of claim 1, wherein an importance of the alarm is defined in a plurality of levels, and wherein when the alarm is issued in the alarm informing device and an alarm at the same importance level as the alarm issued in the alarm informing device is issued in the other alarm informing device, the alarm sound of the alarm informing device is outputted so that an output period of time thereof overlaps with that of an alarm sound of the other alarm informing device, through the control by the alarm sound output timing control module.

7. The alarm informing device of claim 1, wherein when an output period of time of the alarm sound of the alarm informing device overlaps with that of an alarm sound of the other alarm informing device, a timing of starting to output the alarm sound of the alarm informing device is matched with that of the alarm sound of the other alarm informing device, through the control by the alarm sound output timing control module.

8. The alarm informing device of claim 1, wherein the time synchronizing module synchronizes the internal clock of the alarm informing device with a GNSS time.

9. The alarm informing device of claim 1, wherein the time synchronizing module synchronizes the internal clock of the alarm informing device with the internal clock of the other alarm informing device by using either one of a network time protocol and a simple network time protocol.

10. The alarm informing device of claim 1, wherein the alarm informing device is connected with the other alarm informing device and provides navigation information.

11. The alarm informing device of claim 1, wherein the one or more sensors include at least one kind among a GPS navigation system, a heading sensor, an acoustic depth meter, a radar sensor, a Doppler sonar, a wireless communication device, and an AIS.

12. An alarm informing system comprising one or more sensors and a plurality of alarm informing devices for receiving detection information from the one or more sensors and informing an alarm to a user when either one of failure in one of the one or more sensors and error in the reception of the information from the one or more sensors, wherein each of the plurality of alarm informing devices includes at least one of a radar and an electronic nautical chart display system, both of the radar and the electronic nautical chart display system being configured to provide navigation information based on the detection information from the one or more sensors, wherein the one or more sensors include at least one of a GPS navigation system, a heading sensor, an acoustic depth meter, a radar sensor, a Doppler sonar, a wireless communication device, and an AIS, each of the plurality of alarm informing devices is either one of a radar and an electronic nautical chart information display system, and each of the plurality of alarm informing devices includes:

a processor configured to execute:

a time synchronizing module configured to synchronize an internal clock of the alarm informing device with an internal clock of another alarm informing device; and an alarm sound output timing control module configured to control a timing of outputting an alarm sound when the alarm is issued due to the either one of the failure and the error, based on the internal clock of the alarm informing device; and a sound outputter configured to output the alarm sound at the timing controlled by the alarm sound output timing control module, the sound outputter being one of a buzzer, a chime, or a speaker.

13. A method of informing an alarm in an alarm informing device for receiving detection information from one or more sensors and informing an alarm to a user when either one of failure in the one or more sensors and error in the reception of the information from the one or more sensors occurs, the alarm informing device being either one of a radar and an electronic nautical chart information display system, the method of informing the alarm comprising:

synchronizing an internal clock of the alarm informing device with an internal clock of another alarm informing device;

controlling a timing of outputting an alarm sound when the alarm is issued, based on the internal clock of the alarm informing device; and outputting the alarm sound at the controlled timing.

14. The method of claim 13, wherein the timing of the alarm sound is outputted further based on the stored information regarding the timing of outputting the alarm sound from the alarm informing device, the timing being in association with the other alarm informing device.

15. The method of claim 14, wherein the stored information is specified a time frame assigned with the alarm informing device among a plurality of time frames prepared as candidates for outputting the alarm sounds therewithin.

16. The method of claim 14, wherein the timing of outputting the alarm sound of the alarm informing device is controlled to match with a timing of outputting an alarm sound of the other alarm informing device when the alarm informing device is categorized in the same group with the other alarm informing device.

* * * * *